United States Patent [19]

Walker

[11] 4,004,187

[45] Jan. 18, 1977

[54] PUSH-PULL INVERTER BALLAST FOR ARC DISCHARGE LAMPS

[75] Inventor: Loren H. Walker, Schenectady, N.Y.

[73] Assignee: General Electric Company, Schenectady, N.Y.

[22] Filed: Feb. 23, 1976

[21] Appl. No.: 660,687

Related U.S. Application Data

[63] Continuation of Ser. No. 516,788, Oct. 24, 1974, abandoned.

[52] U.S. Cl. ..... 315/205; 315/DIG. 5; 315/DIG. 7; 321/18

[51] Int. Cl.[2] ..... H05B 37/00

[58] Field of Search ..... 315/DIG. 5, DIG. 7, 315/205; 331/113 A; 321/2, 18, 44

[56] References Cited

UNITED STATES PATENTS

| | | | |
|---|---|---|---|
| 3,418,557 | 12/1968 | Shaefer | 321/18 |
| 3,579,026 | 5/1971 | Paget | 315/99 |
| 3,742,330 | 6/1973 | Hodges et al. | 323/DIG. 1 X |
| 3,859,586 | 1/1975 | Wadlington | 321/18 |
| 3,916,282 | 10/1975 | Rothermel | 321/2 |

*Primary Examiner*—Robert Segal
*Assistant Examiner*—Lawrence J. Dahl
*Attorney, Agent, or Firm*—Stephen B. Salai; Joseph T. Cohen; Jerome C. Squillaro

[57] ABSTRACT

A push-pull ballast for an arc discharge lamp has a high power portion comprising a semiconductor switching inverter and transformer means for step-up or step-down of voltage to be supplied to a load and a low power portion comprising control means sensitive to load parameters as, for example, load current which provides instantaneous control over the switching inverter thereby providing the advantages of high input power factor and precise control over the load voltage and current characteristics.

16 Claims, 20 Drawing Figures

Fig. 5
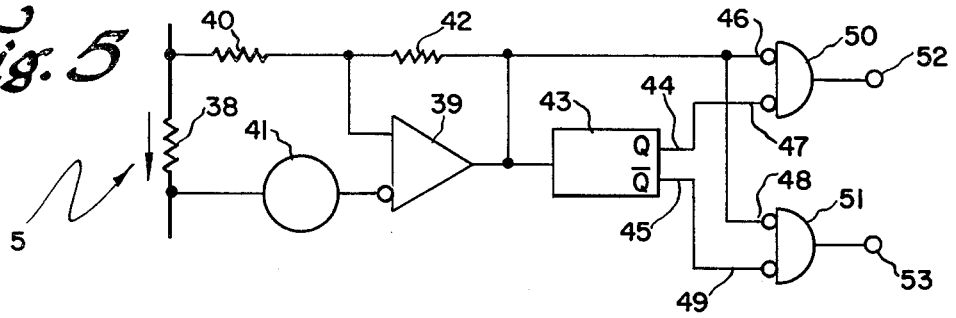
Fig. 6
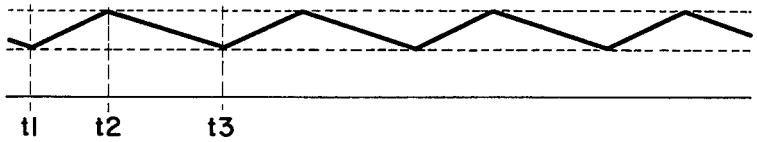
Fig. 7
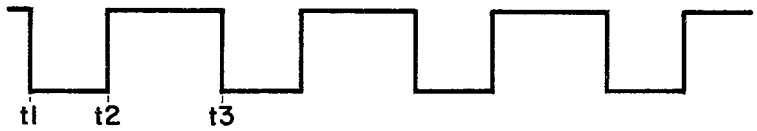
Fig. 8
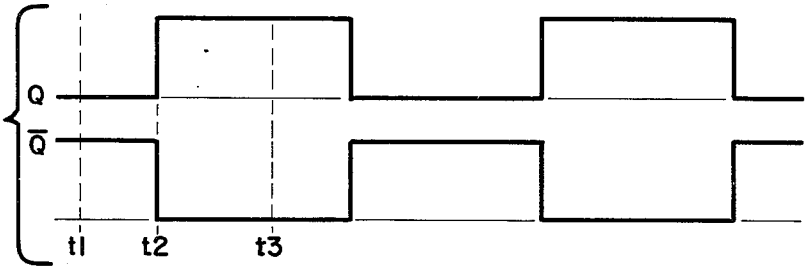
Fig. 9
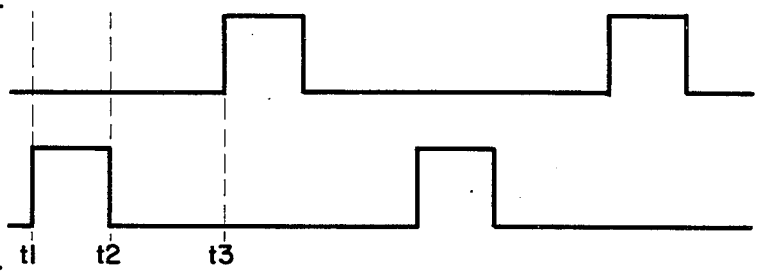
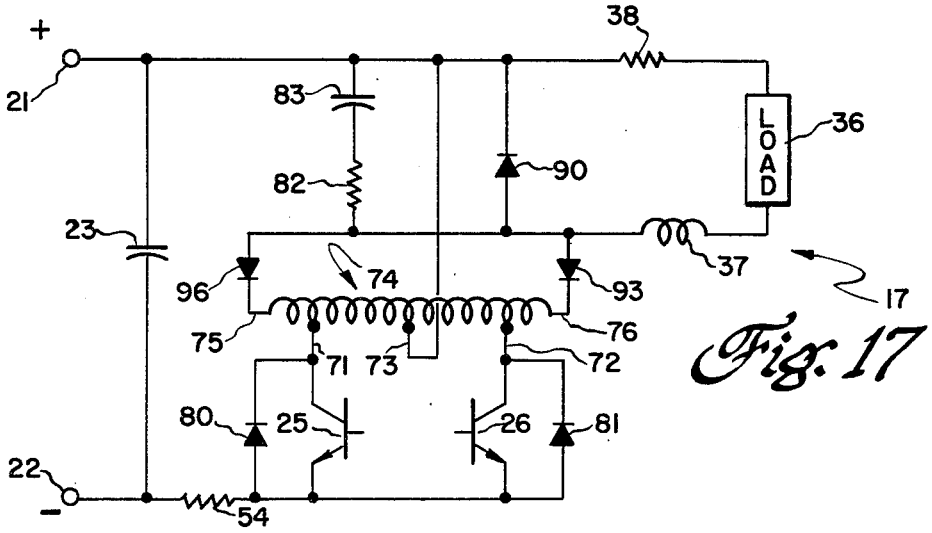
Fig. 17

Fig. 10
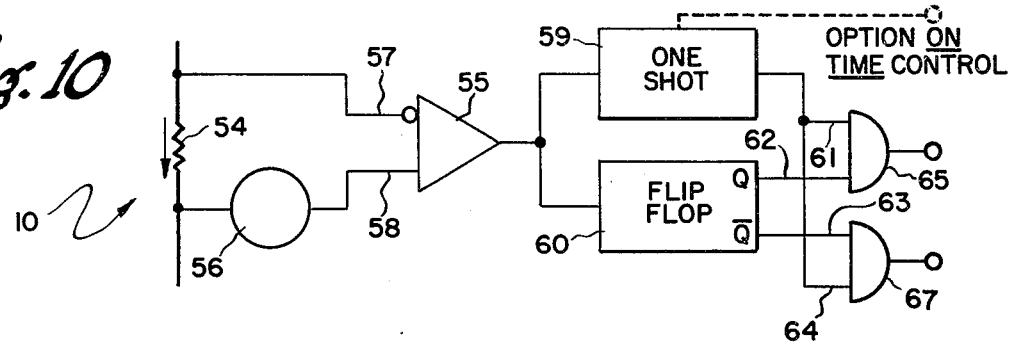
Fig. 11
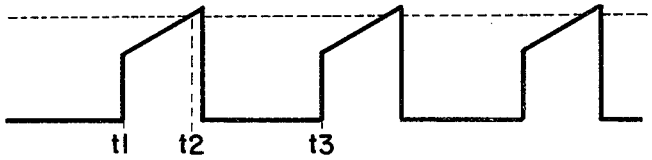
Fig. 12
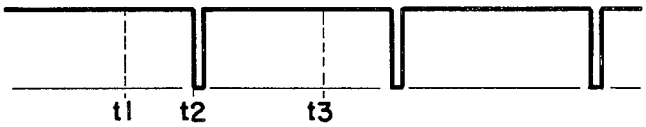
Fig. 13
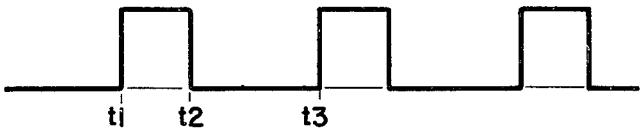
Fig. 14
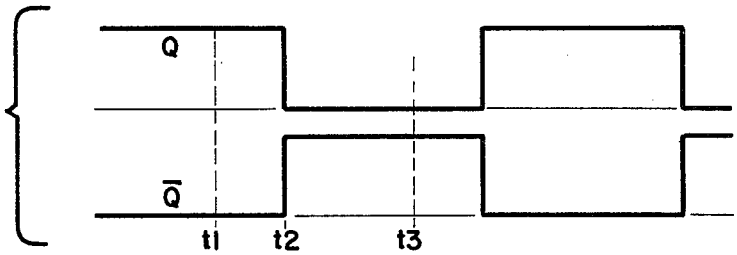
Fig. 15
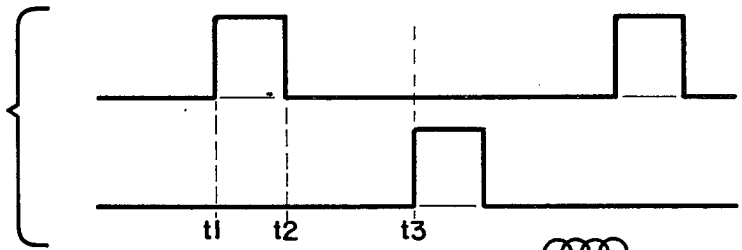
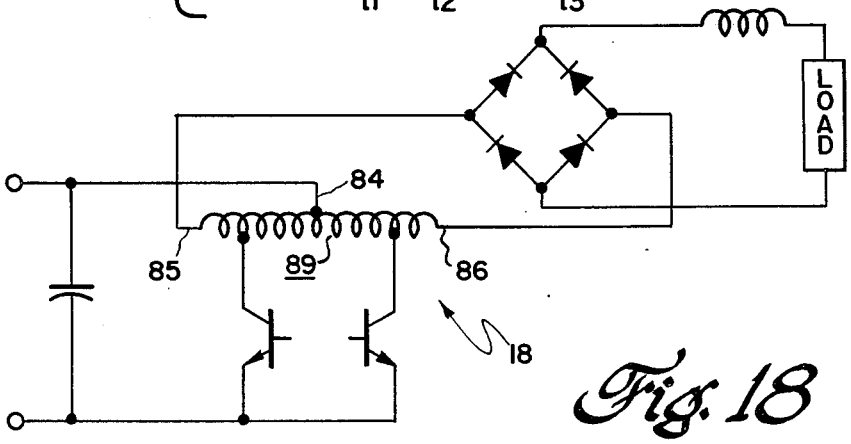
Fig. 18

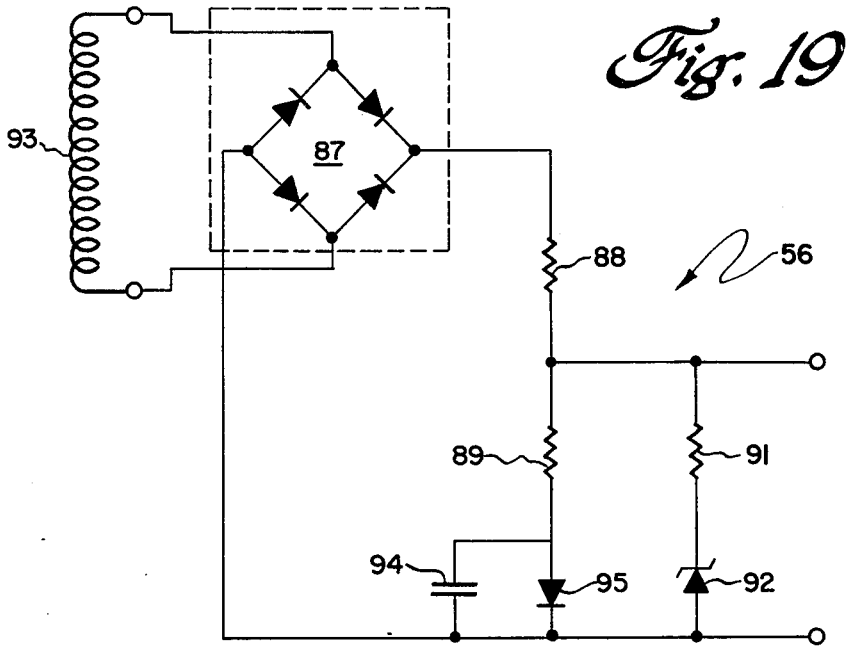
Fig. 19
Fig. 20
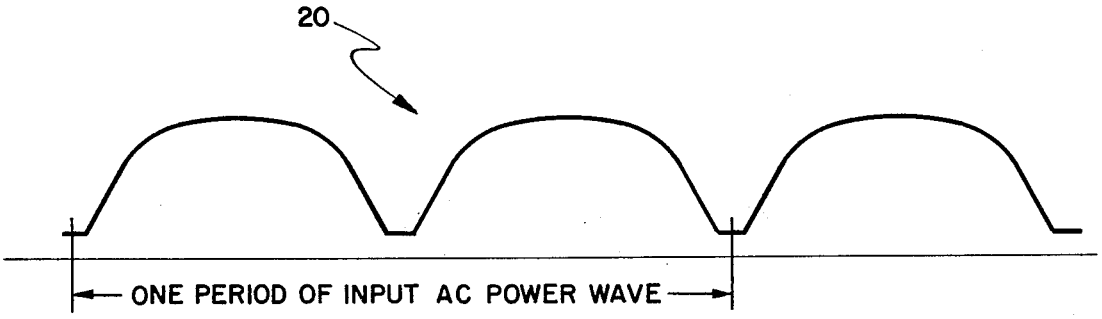

PUSH-PULL INVERTER BALLAST FOR ARC DISCHARGE LAMPS

This is a continuation of application Ser. No. 516,788, filed Oct. 24, 1974, now abandoned.

This invention relates, in general, to push-pull inverter power supplies and, more particularly, to such supplies for use in the operation of arc discharge lamp devices.

The problems attendant to the operation of arc discharge lamps are well known to those skilled in the art. In order to start such lamps, a high voltage at a relatively low current is required, while during operation a substantially lower voltage at greatly increased current is required. In addition, the arc voltage of the lamp may vary over a wide range during initial warm up of the lamp. For example, a lamp having an initial arc voltage of 30 volts may exhibit a 100 volt arc voltage when full operation temperature is reached. The operating characteristics of such lamps are inherently unstable due to the negative resistance characteristic thereof. It is still another characteristic of such devices that the voltage required to sustain the arc is more or less independent of the current supplied. This voltage may vary for different lamps, from a value significantly below the available line voltage to a value somewhat in excess thereof depending on the particular circumstances of the installation of the lamp. In the past, a number of approaches to these various operating problems have been advanced. For example, the use of high Q resonant circuits or voltage doublers to provide a high voltage to start the lamp followed by a low voltage at relatively high current to sustain the operation of the lamp has been proposed. It has long been the practice to stabilize the operation of the negative resistance lamp by insertion of a series inpedance between the source of power for the lamp and the lamp itself. The problem of providing suitable operating voltage to sustain the arc has been approached in a number of manners. For example, ferro resonant autotransformers have long been used to increase the line voltage to a level sufficient to properly operate a lamp while providing isolation from small line voltage purturbations. In the case where the available line voltage was in excess of that required to properly operate the lamp, step-down transformers or alternately choppers have been used. While some success has been achieved through the use of these methods, substantial areas for improvements still exist. For example, the use of series impedance, as for example a ballast inductor to stabilize the operation of arc discharge lamps creates a problem of its own. Since energy is in fact stored in said series impedance means, the power factor of the lamp and the associated ballast taken as a whole has been lower than is optimum.

Accordingly, it is an object of this invention to provide a push-pull inverter ballast for arc discharge lamps which permits operation from a source of line voltage having a magnitude either greater or lesser than the magnitude necessary to properly operate the lamp.

It is another object of this invention to provide a push-pull inverter lamp ballast which does not require a series ballast impedance and therefore is not necessarily encumbered by a low power factor.

Briefly, these and other objects are achieved in accordance with one embodiment of the invention wherein a solid state push-pull lamp ballast is described. The ballast comprises a solid state inverter for energization from either d.c. or pulsating rectified a.c. including step-up or step-down transformer means and solid state switching means associated therewith for causing alternating current flow in the primary of said transformer. Control means for said switching means are provided which vary the on-time of the switching means in response to an instantaneous current signal proportional to the current in the lamp to be powered.

It is a feature of this invention that the need for a passive series ballast impedance is eliminated, and that the power factor may therefor be made close to unity without the use of large correction impedances.

It is another feature of this invention that the instantaneous lamp current may be programmed to achieve a desired waveshape and thereby provide a desirable power factor.

It is another feature of this invention that operation is accomplished without the need for filtering of the rectified line frequency power.

While the scope of the present invention is pointed out with particularity in the appended claims, the invention along with further objects and advantages thereof may be better understood by reference to the accompanying detailed description thereof taken in conjunction with the drawings and in which:

FIG. 5 is a block diagram schematic representation of one embodiment of a control circuit for this invention.

FIGS. 6–9 are graphic representations of various voltages and currents present in the control circuit of FIG. 5 as a function of time. In order that the operation of the embodiment of FIG. 5 be most readily understood, the time base remains constant from graph to graph.

FIG. 10 is a block diagram schematic representation of another control circuit in accordance with this invention.

FIGS. 11–15 are graphic representations of various voltages and currents present in the control circuit of FIG. 10 as a function of time. In order that the operation of the embodiment of FIG. 10 be most readly understood, the time base remains constant from graph to graph.

FIG. 17 is a schematic representation of the high power portion of an embodiment of this invention utilizing an autotransformer.

FIG. 18 is a schematic representation of the high power portion of an embodiment of this invention using a minimum transformer means when the lamp voltage is approximately twice the input voltage.

FIG. 19 is a schematic representation of a voltage reference source in accordance with one embodiment of this invention.

FIG. 20 is a graphic representation of the output waveform of the voltage reference source of FIG. 19.

Figure 1:
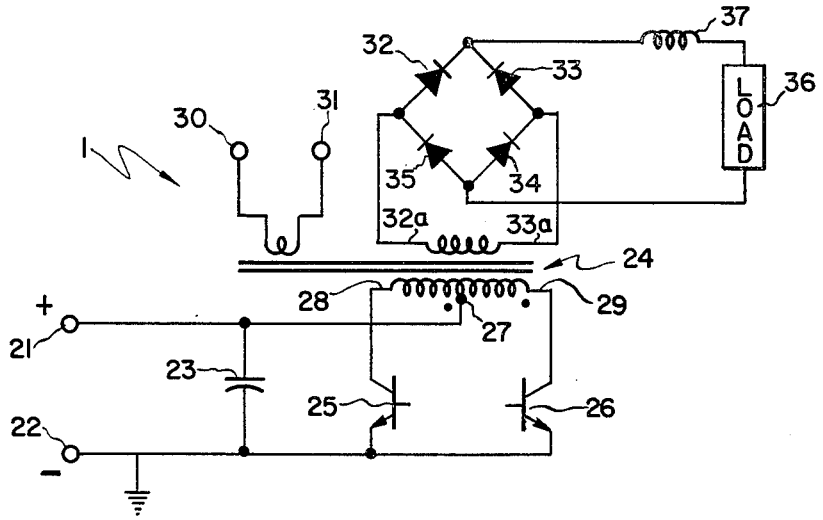
FIG. 1 is a schematic diagram of one embodiment of the present invention showing only the high power portion and omitting the control means.

FIG. 1 is a schematic diagram of the high power portion of a push-pull lamp ballast 1 in accordance with one embodiment of this invention. It is the nature of this invention that the high and low power portions, that is to say, the power portions and the control portions are susceptible to being chosen separately depending upon the ultimate use desired. Input terminals 21 and 22 are adapted to be connected to a source of d.c. power. This source may take the form either of pure d.c. or, if operation from an a.c. source is contemplated, full-wave rectified a.c. without filtering. Pulsating d.c. is satisfactory and, in fact, desirable as a power source in accordance with this invention. Capacitor 23 shown connected between terminals 21 and 22 provides a high frequency filter for the operation of the inverter, and is not intended as a filter for the pulsating d.c. Accordingly, the value of the capacitor need only be high enough to provide a low impedance path at the high operating frequency of the inverter. At the frequencies generally contemplated by this invention, a value no greater than 10 microfarads has been found to be sufficient.

Transformer 24 and associated transistors 25 and 26 comprise a more or less standard inverter. While in the configuration shown, NPN transistors are used, it is emphasized that where it is desirable that the positive d.c potential be connected to ground the complementary form of inverter wherein PNP transistors are used is equally applicable to the purposes of this invention. Accordingly, center tap 27 of transformer 24 is connected to the positive d.c. potential. The extremities of the primary winding 28 and 29 are shown connected respectively to the collectors of transistors 25 and 26. Hereafter, transformer windings will be identified by the reference numerals of their terminations, i.e., the primary winding 28–29. The emitters of transistors 25 and 26 are shown connected together and therein connected to terminal 22 which may, if desired, be connected to ground. No connections are shown to the bases of transistors 25 and 26 and it is to be understood that connection is made to a control circuit either of the type hereinafter described or of a type not described which is applicable to a particular purpose depending upon the use contemplated for the ballast in accordance with this invention. The secondary of transformer 24 as shown herein comprises two windings. The winding 30–31 is optional and may be utilized if desired to supply power for the control circuits to be discussed below. Winding 32*a*–33*a* is the output windings and is shown herein as connected to a bridge rectifier comprising diodes 32–35, connected in the conventional full wave bridge relationship. The pulsating d.c. output of the bridge rectifier is connected to a desired load 36 through series inductor 37, the function of which is to filter our high frequency components of the rectified d.c. waveform. It is emphasized that although it appears in the same circuit relationship to the load as a conventional ballast inductor, inductor 37 does not function as a ballast inductor and serves only to filter high frequency components generated by the inverter.

The fundamental frequency of operation of the inverter is constrained by several factors. While greater efficiency with smaller transformer components may generally be obtained by high frequency inverter operation, the limitation on the electromagnetic interference which may be coupled to the power lines makes operation above 30 kilohertz generally undesirable. As a lower constraint, frequencies significantly below 20 kilohertz may well be audible and therefore objectionable in environments where audible noise is a factor. It is emphasized, however, that while these constraints may prove applicable in particular applications, they are not constraints on the operation of the invention for any other reason.

Figure 2:
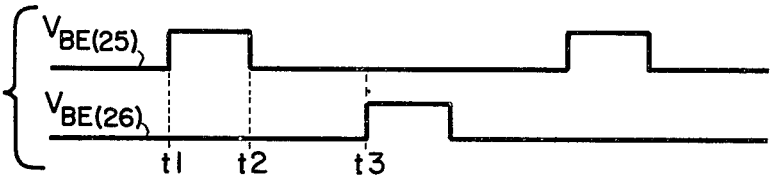
FIGS. 2–4 are graphic representations of various voltages and current present in the inverter of FIG. 1 as a function of time. In order that the operation of the embodiment of FIG. 1 be most readily understood, the time base remains constant from graph to graph.

While the inverter is depicted using bipolar transistors as switches to accomplish proper operation, it is not intended that the invention be restricted to devices of this type. As is known to those skilled in the art, numerous other devices, as for example gate turn-off thyristors, may be utilized to accomplish the switching which is essential to the operation of this invention. It is, however, necessary that whatever means are employed be capable of being both turned-on, that is placed into a conducting state, and turned-off, that is that they have the ability to interrupt a current flow by application of a signal to a control terminal. For this reason, in the embodiment illustrated, silicon controlled rectifiers would not be appropriate for use as switches since they lack the ability to interrupt a current flow. It is appreciated, however, that by the addition of commutation means silicon controlled rectifiers may be useful in inverters of this type. In order to insure that the highest possible efficiency is obtained, it is preferable that the turn-on and turn-off times of the devices employed be as short as possible, and that the inverter be operated in a mode which as closely as possible approximates a square wave mode. The fact that square wave operation is not only permissible but desired, allows digital techniques to be utilized in the control portion of this invention. For purposes of illustrating the operation of this particular embodiment of the invention, typical waveforms will be discussed in connection with FIGS. 2 through 4. In all cases, the magnitudes of the voltage and/or the currents illustrated are approximate, and the time scale in each case is the same so that the causes and effects of the various voltages and currents may be compared easily. FIG. 2 shows the base-to-emitter voltage of the two transistors 25 and 26 on separate axes as a function of time. It is emphasized that this voltage is typical only, and may or may not be used or desirable in any particular use of this invention. The characteristics of this waveform which are of particular importance are the rather short rise and decay times of the waveform. The upper limit of the waveform is the base to emitter voltage of the transistor and corresponds in duration to the time when the transistor is conducting or "on". The lower limit is zero. In this example, initially neither transistor is on, and therefore no current will flow in the inverter circuit. At t1 the base-to-emitter voltage of transistor 25 rises to its maximum value and transistor 25 begins to conduct. At *t*2 the base-to-emitter voltage falls to zero and transistor 25 ceases to conduct. From time *t*2 to *t*3 neither transistor is conducting and at time *t*3 transistor 26 begins to conduct and does so for a predetermined time. This cycle is repeated, that is, first transistor 26 conducts followed by a period wherein neither transistor conducts and then transistor 26 conducts. It is emphasized that the time intervals are to be selected depending upon the voltage and current desired to be presented to the load. There are, of course, constraints. The maximum time during which either transistor may remain on is limited by the time in which the transformer core will saturate and therefore no more current will be induced in the secondary windings. This time varies depending on the voltage and the type of core employed. One method for insuring that saturation does not occur is to provide control means having a constant on time and varying the time between the "turn-off" of transistor 25 and the "turn-on" of transistor 26 to meet the changing load requirements.

In the embodiment of FIG. 1 as well as in all the embodiments to follow, it is a requirement of this invention that the design of the control circuit be such that at no time is base current supplied to both transistor 25 and transistor 26 simultaneously. It is necessary, therefore, that if a constant On time is the operable mode, that the OFF time of each transistor never be reduced below 50%.

Figure 3:
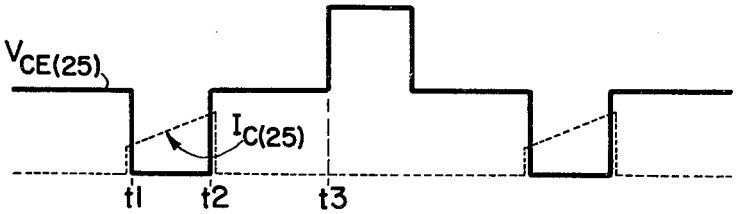

FIG. 3 shows on two separate axes the collector-to-emitter voltage of transistor 25 and the collector current of transistor 25. During the time when both transistors 25 and 26 are OFF, the collector voltage is equal to the supply voltage of the d.c. power source. At time *t*1 when the base-to-emitter voltage rises to a point sufficient to turn transistor 25 ON, the collector-to-tmitter voltage falls to the saturation voltage which is approximately zero. It remains at approximately zero during the time that the base-to-emitter voltage remains sufficient to insure that the transistor is turned ON. At time *t*2 when the base-to-emitter voltage falls to zero, the collector-to-emitter voltage of transistor 25 again rises to the supply voltage. At time *t*3, the voltage across transistor 26 falls instantaneously to zero and consequently the voltage across transistor 25 rises to two times the d.c. source voltage and remains at this magnitude as long as transistor 26 is ON. This, of course, assumes that the ON time of the transistors 25 and 26 is shorter than the saturation time of transformer 24. FIG. 3 also shows the collector current for transistor 25 in accordance with this invention. When transistor 25 is OFF it is clear that the collector current is zero. When the base-to-emitter voltage increases to a level sufficient to turn transistor 25 ON, current begins to flow in the primary of transformer 24. As long as transformer 24 does not saturate, the current through transistor 25 increases in a linear fashion until the base-to-emitter voltage decreases to zero.

Figure 4:
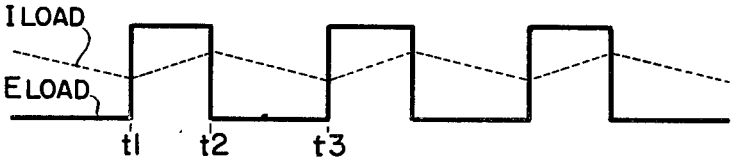

FIG. 4 shows the output voltage and output current as a function of time for this embodiment of the push-pull inverter ballast circuit. The voltage as shown is the result of the full-wave rectification of the voltage on the secondary transformer 24 which is further the result of the superposition of the voltages produced by transistors 25 and 26 across the primary winding. The current does not fall to zero due to the fact that the inductance of inductor 37 does not permit an instantaneous current change. As shown, it increases during the time that either transistor 25 or 26 is conducting, and decreases during the time that both transistors are OFF. The discussion so far has assumed that the voltages illustrated in FIG. 2 as the base-to-emitter voltages of the transistors are available. The following discussion will relate to a novel control circuit for creating these waveforms and the timing thereof in response to the current and voltage requirements of the particular load involved. While specific embodiments, as for example those shown in FIG. 5 and FIG. 10, will be illustrated for the purpose of enabling one skilled in the art to practice the instant invention it is emphasized that these embodiments are exemplary only and that the requirements of specific applications may differ requiring different adaptations of the basic circuits which will be described. It is, however, a common feature of the control circuits to be described and of all modifications thereof that instantaneous current control without the use of a passive ballast impedance is present.

FIG. 5 is a block diagram schematic of a control circuit 5 in accordance with one embodiment of this invention. The circuit illustrated provides full current control, that is to say, both the upper and the lower limits of the current which are supplied to the load are controlled by this circuit. As illustrated, shunt resistor 38 provides a voltage signal proportional to the instantaneous current flowing through it. As will be discussed below, this resistor may be placed at any one of several points in the circuit, the only requirement being that the current flowing through it either be the load current, or be proportional to the load current. The value of shunt resistor 38 may be chosen to provide any desired voltage drop consistent with the requirements of the load. It is preferable that the resistor be kept as small as possible consistent with providing sufficient voltage signal for proper operation of the comparator. Assuming, as is usually the case, that the current through resistor 40 is low, and consequently that the voltage drop across resistor 40 is also low, the control circuit acts to assure that the voltage produced across shunt resistor 38 is substantially equal to the voltage produced by voltage reference source 41. One terminal of shunt resistor 38 is treated for purposes of the control circuit as the reference or zero voltage point. Reference voltage source 41 shown as a block only has one terminal connected to this point and another terminal connected to one input of a comparator 39. The other input of comparator 39 is connected through a resistor 40 to the other side of shunt resistor 38. The specific design of comparator 39 is not critical to the operation of this invention. It is only required that the comparator provide a two-level output suitable for driving logic circuits. For purposes of the following discussion, the output of comparator 39 will be referred to as either "high" or "low", the terms having their conventional and well-known logic circuit meanings. Depending upon the particular configuration of the control circuit, the high or low voltages may vary widely in actual magnitude. It may be preferable in some cases for the high voltage to be positive voltage and the low voltage to be a negative voltage with respect to a common circuit ground. In the figures, the low voltage will, for purposes of easy illustration, be assumed to be zero and the high voltage will have an arbitrary positive value. Resistor 42 shown in feedback relationship around comparator 39, having one terminal connected to the output of comparator 39 and the other terminal connected to the positive input of comparators 39, is a relatively high value resistor and provides the comparator with a hysteresis type response. This allows some variation in the voltage appearing across shunt resistor 38 as compared to the reference voltage generated by reference voltage source 41 before the sense of the comparator output changes from either high or low to the opposite sense. Some degree of hysteresis is necessary in a circuit of this type to limit the rate at which the output of the comparator changes sense and thus the rate at which transistors 25 and 26 of FIG. 1 alternate conduction. As is well known to those skilled in the art, the degree of hysteresis present in the circuit described is a function of the values of resistors 40 and 42 and of the output levels selected for comparator 39 in accordance with well known relationships. The degree of hysteresis which is used in any particular embodiment determines the degree of preciseness with which the output current of the inverter in accordance with this invention is controlled. The output of comparator 39 is applied to the input of JK flip-flop 43 which again is selected to be compatible with the comparator selected for the particular embodiment. The output of comparator 39 is also connected to the inputs 46 and 48 of logic gates 50 and 51. Logic gates 50 and 51 are AND gates of conventional type. JK flip-flop 43 has two outputs 44 and 45. When output 44 is high, output 45 is low and vice versa. Ouput 44 is connected to input 47 of logic gate 50. Output 45 of JK flip-flop 43 is connected to input 49 of logic gate 51. The outputs 52 and 53 of logic gates 50 and 51 provide the base drive signals to transistors 25 and 26 in the power circuit selected for the embodiment of the invention desired as, for example, that shown in FIG. 1. As was the case when considering switching comparator 39, the flip-flop and logic gates indicated by the blocks in FIG. 5 may be any convenient type. It is, of course, necessary that the output of switching comparator 39 be compatible with the inputs both of logic gates 50 and 51 and JK flip-flop 43, and that the outputs 44 and 45 of flip-flop 43 be compatible with the inputs 47 and 49 of logic gates 50 and 51. It is also preferable that the JK flip-flop 43 and logic gates 50 and 51 have rise and decay times as short as possible to insure that the transistor base drive signals supplied to transistors 25 and 26 as closely as possible approximate a square wave. It is perhaps unnecessary to point out that in the embodiment of the control circuit illustrated in FIG. 5 as well as the embodiments to follow, the supply voltages for the various stages of the circuit have been omitted. It is anticipated that the stages of the control circuit illustrated may take various individual forms and that the supply voltage requirements may therefore vary widely. For this reason and for reasons of simplifying the drawings to better point out the important elements of this invention, all power supply wiring for the control circuit is omitted. The operation of the control circuit of FIG. 5 will now be described in conjunction with FIGS. 6–9. It will be helpful while considering these FIGURES to bear in mind the function performed by the control circuit. When the output current as sensed by resistor 38 rises to a level in excess of the current established by voltage reference source 41 that the power transistor, either 25 or 26 which was conducting at that time be turned off. The output current will then begin to decline and at such time as the output current falls below the current established by the voltage reference source 41, the transistor which was not most recently on should be turned on and remain on until the output current again rises to the level set by the voltage reference source 41. In this way, the transistors will be turned on alternately to produce the desired inverter action as the output current varies between upper and lower limits about the value set by the voltage reference source 41. Again, the limits above and below the normal value at which comparator 39 changes state are a function of the values of the hysteresis resistor 42, resistor 40 and the magnitude of the comparator output voltage.

FIG. 6 shows the current through the load 36 of FIG. 1 as a function of time compared to the upper and lower comparator thresholds which it is understood are values above and below, respectively, of the output load current level established by voltage reference source 41. FIG. 7 shows the output of comparator 39 as a function of time. The time scale on FIG. 7, as well as FIGS. 8 and 9, is the same as the time scale on FIG. 6 so that comparison may be made easily. At time t1 the output of comparator 39 is low transistor 25 is on and remains on as the output current rises above the current set by the voltage reference 41 by an amount determined as described above, to a point where the comparator switches and the output goes high, this point is labeled *t*2. From time *t*2 to *t*3 the output of the comparator remains high as the output current decays and at time *t*3, as the output current falls below the reference current by an amount again established as described above, the comparator output returns to the low state. This process repeats itself as the output current alternately rises above and then falls below the reference current.

FIG. 8 shows the two outputs of flip-flop 43 as a function of time. As can be seen the flip-flop triggers on the rising edge of the comparator pulses and therefore at time *t*2, the flip-flop 43 changes state.

The outputs of logic gates 50 and 51 are shown in FIG. 9. Gate 50 produces an output which is high only when both the output of comparator 39 and the output 44 of flip-flop 43 are both low. Similarly, the output of logic gate 51 is high only when both the comparator 39 output and the output 15 of flip-flop 43 are low. As is seen, pulses are produced of generally rectangular shape which alternately energize the bases of transistors 25 and 26 in response to the output current as compared to the reference current. The rate at which the ballast in accordance with this invention responds to changes in current through the load 36, is limited only by the speed of the logic and power switching elements which comprise it and the degree of hysteresis incorporated into comparator 39. Essentially, the response is instantaneous and therefore exhibits none of the characteristics of a series passive ballast element as was heretofore the practice in the art. It is possible, therefore, to achieve a significant improvement in power factor drawn from the line through the use of this invention.

While the circuit shown in FIG. 5 as amplified by the waveforms of FIG. 6–9 is useful in explaining the operation of the invention, several additions are desirable to provide a more useful operating control circuit. For example, it can be seen that as the load on the inverter is decreased and consequently the output current is reduced to lower and lower values, the frequency of the inverter is reduced by the control circuit to lower and lower values and eventually stops with one transistor in conduction, thereby saturating the transformer and leading to the probable destruction of the transistor or transformer or both. In order to prevent this, it is preferable that flip-flop 43 be designed with a free-running frequency below which it would not operate, this frequency being high enough that saturation of the transformer does not occur.

FIG. 5 also omits a starting circuit for the inverter. If the optional secondary winding 8–9 of FIG. 1 is used to supply power to the control circuit, it is clear that no power is available to operate the control circuit until one of the transistors 25 or 26 is initially turned on. It is, therefore, necessary that a single pulse be supplied by external means to one or the other of transistors 25 and 26 to provide an initial start-up function. For example, the combination of a diode and a capacitor to be charged from the line voltage may be connected to the base of one of the transistors 25 or 26 so that upon energization as the rectified line voltage is applied to the capacitor and the voltage thereon increases, a point is reached where sufficient voltage is available to turn on the transistor and start the oscillations.

In FIG. 5 shunt resistor 38 is placed in the circuit in a position such that either the output current flows through it or that the current flowing through it is proportional to the output current. In certain instances, it may be desirable that the control circuit be completely isolated from the output circuit and therefore it may be difficult to have the current flowing in shunt resistor 38 be precisely proportional to the output current. FIG. 10 shows a peak current control circuit in accordance with this invention wherein the current flowing in the sensor resistor 54 is the combined emitter current of transistors 25 and 26. When either transistor 25 or 26 is on, this current is proportional to the load current since the load is reflected across the transformer and is seen at the primary. When, however, neither transistor 25 nor 26 is on, and the load current is decaying across the secondary of transformer 24, there is no effect which causes a current to flow in resistor 54. It is necessary, therefore, that the peak current control circuit 10 of the FIG. 10 produce an artificial lower current limit.

The input portion of the circuit illustrated in FIG. 10 is substantially identical to the circuit illustrated in FIG. 5. Shunt resistor 54 is positioned in the high power portion of the inverter so that the emitter or collector currents of both transistors 25 and 26 flow through it. For example, in FIG. 1, this resistor would be placed in the negative d.c. voltage path between capacitor 23 and transistors 25 and 26. The voltage appearing across resistor 54 therefore is proportional as defined by Ohm's law, to the current flowing through it. In FIG. 10, one terminal of resistor 54 is connected directly to input 57 of comparator 55 while the other terminal herein considered the zero voltage reference terminal is connected through voltage reference source 56 to the other input terminal 58 of comparator 33. In this way the signal appearing across the input of comparator 55 will be the difference in voltages between the voltage appearing across resistor 54 and the voltage of voltage reference source 56. As was the case in the control circuit of FIG. 5, the inputs 57 and 58 of comparator 55 are shown as noninverting input 58 and an inverting input 57. This is a commonly found configuration of the devices adapted to be utilized as comparators in the circuit. It is to be understood that the use of the inverting and non-inverting inputs is a matter of preference only and that by suitable orientation of the voltages produced by current sensing resistor 54 and voltage reference source 56 it will be possible to utilize a comparator having either none, one or both of the inputs as inverting inputs. Unlike the example illustrated in FIG. 5, comparator 55 is not provided with a hysteresis resistor. Therefore, the output of comparator 33 will be high only when the voltage across resistor 54 exceeds the voltages of reference source 56, that is to say, when the current flowing in resistor 54 exceeds the preselected current as represented by the voltage source 56. The output of comparator 55 is connected to the inputs of one shot multivibrator 59 and flip-flop 60, respectively. The output of one-shot multivibrator 59 is connected to the inputs 61 and 64 of logic gates 65 and 67, respectively. The outputs 68 and 69 of flip-flop 60 are connected to the remaining inputs 62 and 63 of logic gates 65 and 67. As opposed to FIG. 5, logic gates 65 and 67 are AND gates of conventional type.

The operation of the peak current control circuit of FIG. 10 may be easily understood by reference to the FIGS. 11 through 15 wherein various waveforms associated with the current control circuit are illustrated. As was the case in the current control circuit discussed above, the time scales on FIGS. 11 through 15 are the same so that the operation and relationship between various components of the peak current control circuit may be easily compared. Again, the voltage scales are arbitrary and represent for the most part high and low logic states only. For purposes of this discussion the current control circuit will be assumed to be operating in the steady state mode and all transient conditions due to start-up will be assumed to have subsided. FIG. 11 shows the total current flowing in shunt resistor 54 as a function of time. This current is the sum of the emitter currents of transistors 25 and 26 of FIG. 1. Also shown is a dotted line representing the comparator threshold, that is, the current level at which the comparator changes state. The level of this threshold is determined by the voltage reference source 56. From time $t1$ to $t2$ transistor 25 is energized and the increasing slope of the current corresponds to increasing current in the secondary 32*a*–33*a* of transformer 24. At time $t2$, when the current exceeds the preset threshold level, the comparator output changes state, in this case from high to low as indicated in FIG. 12. The change in state of comparator 55 output triggers both one shot multivibrator 59 and flip-flop 60 as shown in FIGS. 13 and 14, respectively. FIG. 13 shows the output of one-shot multivibrator 59. The normal or quiescent condition of the output is the high state. Upon being triggered by the change in state of the output of comparator 55, one-shot multivibrator 59 changes state for a preselected fixed time as indicated in FIG. 13 from $t2$ to $t3$. Flip-flop 60 is also triggered by the change in state of the comparator 55 output. The flip-flop outputs labeled as above Q and $\overline{Q}$ are, as before, complementary, that is, when Q is high, $\overline{Q}$ is low and vice versa. In FIG. 14 at time $t2$ $\overline{Q}$ changes from low to high, and Q changes from high to low. The output of one-shot multivibrator 59 is divided and connected to input 61 of logic gate 65 and input 64 of logic gate 67. The outputs of flip-flop 60 are connected Q to input 62 of logic gate 65 and $\overline{Q}$ to input 63 of logic gate 67. The outputs of logic gates 65 and 67 provide the base drive signals to power transistors 25 and 26 and these outputs are illustrated in FIG. 15. At time $t1$, transistor 25 is ON and remains ON until the current through shunt resistor 54 increases to the comparator threshold level. The base drive for transistor 25 is then removed and remains OFF. After the preselected fixed time of the one-shot multivibrator returns to the high condition and base drive is applied to transistor 26 which consquently turns ON. Again, when the current to shunt resistor 54 increases to the level of the comparator threshold the power to the base of transistor 26 is removed for a preselected time. The advantage of providing a lamp ballast wherein the lamp can be completely isolated from the power line for reasons of safety or for other reasons which may be desirable, makes the embodiment of the control circuit of FIG. 10 the preferred one in many instances. This control circuit provides direct control of the maximum current, but only indirect control of the minimum current. Where it is desirable that the average lamp current be more closely controlled than is possible with a fixed duration one-shot multivibrator as illustarated at 34, it is preferable to provide means for varying the ON time of the multivibrator in response to a selected circuit parameter, for example, to the voltage across the lamp, the current through the lamp, the line voltage, line current, or some combination of these or other parameters which it may be desirable to optimize in a particular instance desired.

Figure 16:
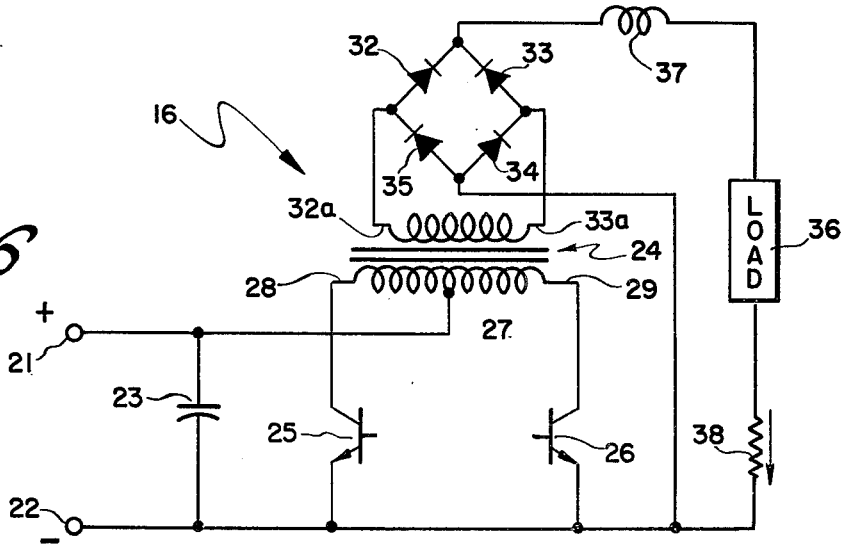
FIG. 16 is a schematic representation of the high power portion of an embodiment of this invention showing a particular current measuring shunt configuration.

FIG. 16 is a schematic diagram of an embodiment 16 of this invention wherein the placement of a shunt resistor 38 is shown. The placement of the shunt resistor as illustrated provides a measure of current through the load of a nature that provides full control over said current. The control circuit illustrated in FIG. 5 is appropriate for use with this embodiment of the high power portion of the inverter. The circuit illustrated in FIG. 16 is substantially identical to that illustrated in FIG. 1, save only that the secondary winding designated 30–31 in FIG. 1 is omitted for the purpose of clarity, and that the shunt resistor 38 is shown having one terminal thereof connected to the negative lead of the d.c. power source. As was previously mentioned, this method of sensing load current provides a signal directly proportional to the current in the load, but does this at the expense of isolation of the load from the power source.

FIG. 17 is a schematic diagram of an embodiment of the high power portion 17 of the invention which utilizes an autotransformer to provide the required voltage change from the d.c. source voltage to the load voltage. As was the case in FIGS. 1 and 16, the control circuit portion of this embodiment is omitted and may be selected separately, thereby providing the unique flexibility which is an important characteristic of this invention. The operation of the circuit illustrated by the schematic in FIG. 17 is substantially identical to the operation of the embodiment illustrated in FIG. 1. Accordingly, reference numerals are duplicated where the functions of the components are substantially the same. Capacitor 23 is connected between the positive and negative input terminals 21 and 22 of the inverter and provides a path for the high frequency components generated by the converter thus isolating the power source from these high frequency components. Transformer 74 performs a function substantially identical to that performed by transformer 24 of FIGS. 1 and 16. The portion of the transformer defined by taps 71 and 72 corresponds to the primary and includes center-tap 73. Transistors 25 and 26 are connected with the collectors to taps 71 and 72, respectively, and the emitters connected together and returned to the negative d.c. supply terminal through resistor 54. In this embodiment two sensing resistors will be illustrated. It is emphasized that in a given application only one will be used, the choice depending upon the choice of control circuits utilized in the application involved. Resistor 54 is used to measure the total emitter current of the inverter transistors 25 and 26 and the control circuit illustrated in FIG. 10 is appropriate. The positive d.c. supply connection is connected to center tap 73 of autotransformer 74. Taps 75 and 76 are analogous to the secondary taps illustrated as, for example, in FIG. 1. In this case these taps are provided to yield a step-up in voltage. Where necessary it is emphasized that these taps may be so configured as to yield a reduced voltage at the secondary of transformer 74 merely by including a smaller number of turns than the primary as encompassed by taps 71 and 72. Due to the fact that the autotransformer configuration provides a center tap for the secondary, a bridge rectifier is not necessary and diodes 93 and 96 provide the necessary full-wave rectification to provide d.c. to the load. The anodes of diodes 93 and 96 are connected together and the cathodes are connected to taps 75 and 76, respectively, of transformer 74. The center tap 73 provides the secondary return terminal. The series combination of inductor 37, the load, and current sensing resistor 38 are connected between the junction of the anodes of diodes 93 and 96 and the center tap 73 of transformer 74. Current sensing resistor 38 is suitable to provide a current signal for the type of control circuit illustrated in FIG. 5 wherein full current control is provided. In this case the total load current at all times flows through resistor 38. Diode 90 provides a "free wheeling" path for the current in the load due to the stored energy in inductor 37. This diode provides the function which is provided automatically by the full wave bridge configuration in FIGS. 1 and 16. It is also possible to delete diode 90 and allow the "free-wheeling" current to be carried by simultaneous conduction of diodes 93 and 96 through secondary winding 75–76 if desired. The embodiment illustrated in FIG. 17 provides a substantial saving in power transformer weight over the embodiment illustrated in FIG. 1. Where the step-up ratio required is small, the transformer weight is approximately equal to that of the transformer required in the embodiment illustrated in FIG. 1 multiplied by the percentage increase in voltage required. For example, where the lamp running voltage is 20% above the minimum input voltage, the transformer required for the embodiment of FIG. 17 weighs approximately 20% of that required for the embodiment illustrated in FIG. 1.

FIG. 17 also illustrates a number of refinements which may be preferred in certain embodiments of this invention. It is emphasized that none of these additions are absolutely necessary for the proper functioning of a device built in accordance with the principles disclosed herein, however, they provide improved operation. Diodes 80 and 81 connected across transistors 26 and 26, respectively, with the anodes connected to the emitters of the transistors and the cathodes connected to the collectors of the transistors provide a path for transformer exciting currents at the no-load condition of the inverter, thereby preventing the possibility of destruction of the power transistors due to these exciting currents at the no-load condition. The filter comprising resistor 82 and capacitor 83 connected in series directly across the output of the full-wave rectifier 96 and 93 provides transient suppression for commutating transients generated by these diodes, thus reducing the generated electromagnetic interference in cases where this is desirable. Where such electromagnetic interference is not a problem, it is possible to omit the transient suppression and thereby to realize voltage spikes in excess of the normal running voltage of the inverter which are often of sufficient magnitude to provide starting voltage for particular lamps which are used in combination with this invention. As was mentioned above, it is desirable that the diodes used at all places in this invention have very fast switching times to produce a closely as possible square wave voltages and currents so that losses are minimized. It is also preferable that the transformers used in the embodiments illustrated be tightly coupled for the same reason.

FIG. 18 shows another embodiment 18 of the invention which has particular utility where the operating voltage of the lamp is approximately double the supply voltage. As has been the case in all embodiments, save only the one illustrated in FIG. 1, the secondary winding which provides power to the control circuits is omitted for purposes of clarity. In the lamp ballast circuit of FIG. 18, transformer 89 has windings which correspond to transformer 74 in the embodiment illustrated in FIG. 17. The substantial difference is in the use of a full-wave bridge rectifier connected to terminals 85 and 86 of transformer 84 to provide an output voltage approximately twice the output voltage which would be obtained through the use of a full-wave rectifier. The use of a bridge rectifier obviates the need for an extra diode to handle the free-wheeling load current. No current sensing resistor is shown in the schematic and it is to be understood that it is placed in either of the general position shown in FIG. 17. The embodiment of FIG. 18 provides an inverter lamp ballast which encompasses many of the advantages which are characteristic of ballasts in accordance with the present invention. As shown, it is simple, easy to construct and of extremely light weight compared to previous ballasts. The flexibility provided by the autotransformer 84 is great and as was indicated before, it is possible to provide starting means utilizing the high voltage transient spikes which will appear at the output of this inverter is not suppressed.

Each of the above-mentioned control circuits includes a voltage reference source which has hereinbefore been indicated only as a component block. Although this reference waveform may be constant d.c. voltage, operating advantages may be gained by other waveforms. One preferred waveform is shown in FIG. 20. This reference voltage signal is substantially in phase with the applied line voltage and has a predetermined waveform and magnitude so as to achieve a high power factor and to deliver a predetermined amount of current to the load. As has been pointed out, the current delivered to the load by an inverter in accordance with this invention is determined by the waveform of the reference signal. Additionally, the reference signal waveform is selected to achieve the desirable features of good regulation and suitable load current waveforms to meet the range of load operation conditions. Accordingly, the exact waveform of the reference signal which is selected depends upon the combination of features that are required or the best compromise, depending upon the particular circumstances. Copending U.S. patent application Ser. No. 430,088, filed Jan. 2, 1974, and of common assignee as the instant application, the entire disclosure of which is incorporated by reference herein, describes in greater detail a reference voltage generator which is adaptable to the purposes of the present invention. By way of example, and not of limitation, FIG. 19 of this application shows a voltage reference source 56 which is suitable for incorporation into any of the control circuits above-mentioned. Secondary winding 93 is illustrated as part of a transformer which is not shown adapted to be connected to a source of line frequency power. Bridge rectifier 87 provides a pulsating d.c. voltage across series connected resistors 88 and 89 and diode 95. Resistors 88 and 89 are a voltage divider and the output voltage is taken from the junction joining them. Resistor 91 and zener diode 92 are connected in series between the junction of resistors 88 and 89 and the negative voltage reference point.

FIG. 20 is a graphical representation 20 of the output voltage waveform of the voltage reference source 56 illustrated in FIG. 19. A number of points are of interest. The general shape of the waveform is that of a full-wave rectified sine wave. The maximum voltage is limited by the zener diode 92 to a value somewhat less than the peak voltage provided by the bridge rectifier 87. Resistor 91 allows the voltage to rise slightly above the cut-off voltage of the zener diode to provide a better power factor. Diode 95 and capacitor 94 maintain the minimum voltage zero point so that the lamp current does not decrease to zero on each half cycle and that the lamp therefore does not totally deionize.

A push-pull inverter ballast as described in the foregoing specification provides significant advantages over those known heretofore. The need for a passive ballast element with the capacity to store large amounts of energy during the operating cycle of the lamp is eliminated. A ballast is provided which is suitable for energization from either d.c. or a.c. by means of a full-wave bridge rectifier and which is suitable for operating lamps from power supplies either higher or lower in voltage than the lamp voltage. Control over the lamp current provides an electronic means for varying the lamp power. Shaping of the lamp current provides a means for obtaining a high power factor. The need for filtering rectified a.c. line voltage is eliminated and, in fact, operation from a pulsating d.c. source such as would be obtained merely by rectifying line voltage is desirable.

While the invention has been particularly shown and described with reference to several preferred embodiments thereof, it will be understood by those skilled in the art that the foregoing and other changes may be made therein without departing from the spirit and scope of the invention.

What I claim as new and desire to secure by Letters Patent of the United States is:

1. A push-pull ballast for an arc discharge lamp for operation from a power source either higher or lower in voltage than said lamp operating voltage comprising:

push-pull high frequency inverter means adapted to be connected to a source of unfiltered, pulsating d.c. power, said inverter means including a transformer having a center tapped primary winding and a secondary winding, a pair of controllable solid state switching devices, capable of being turned ON and OFF, said devices connected to said primary winding to cause current to flow therein, and rectifier means operatively associated with said secondary winding and a capacitor connected across said source of pulsating d.c. power, having a high impedance at the frequency of said pulsating d.c. power and low impedance at the frequency of said high frequency inverter, providing substantially no filtering at said frequency of said pulsating d.c. power, means providing a signal proportional to the instantaneous current through the lamp, and a control circuit, including means generating a variable reference signal, comparator means responsive to said reference signal and said signal proportional to said instantaneous current for providing an output signal when said signal proportional to said instantaneous current exceeds said reference signal by a preselected amount and means responsive to said output signal for controlling current flow alternately through each of said switching devices so that each period of conduction of one of said devices is followed by a period during which neither device is conducting and further for causing each period of conduction to terminate in response to said output signal so that said instantaneous current varies in accordance with said reference signal.

2. The push-pull ballast of claim 1 wherein said means providing a signal proportional to the instantaneous current through said lamp comprises a resistor in series with said lamp so that the total lamp current flows through said resistor whereby a voltage signal is produced across said resistor proportional to said current.

3. The push-pull ballast of claim 1 wherein said comparator means further comprises hysteresis means operatively associated therewith so that the output of the comparator will change in sense only when said signal proportional to said instantaneous current differs from said reference signal by an amount which exceeds a preselected value.

4. The push-pull ballast of claim 2 wherein said means responsive to said output signal comprises a flip-flop circuit connected to the output of said comparator, and having an input, and outputs Q and $\overline{Q}$ of differing sense, first and second AND gates, each having two inputs and one output, one input of each of said AND gates connected to the input of said flip-flop circuit, and the other input of said first AND gate connected to said Q output of said flip-flop, and the other input of said second AND gate connected to said $\overline{Q}$ output of said flip-flop, said output of said first AND gate connected to one of said controllable solid state switching devices, and said output of said second AND gate connected to the other of said controllable solid state switching devices, so that said controllable solid state switching devices are energized alternately and further so that there is always a time between successive energization when neither controllable solid state switching devices is on.

5. The push-pull ballast of claim 1 wherein said means providing a signal proportional to the instantaneous current through said lamp comprises a resistor serially connected with said controllable solid state switching devices.

6. The push-pull ballast of claim 5 wherein said means responsive to said output signal comprises a flip-flop circuit connected to the output of said comparator having two outputs, a Q output and a $\overline{Q}$ output of differing sense, a one-shot multivibrator connected to the output of said comparator having an output and input, first and second AND gates, each having two inputs and one input, one input of each of said AND gates connected to the output of said one-shot multivibrator, and the other of said inputs of each first and second AND gates connected to said Q and $\overline{Q}$ outputs of said flip-flop, respectively, and the outputs of said first and second AND gates connected to said controllable solid state switching device, one ouput to each device so that said controllable solid state switching devices are energized alternately, and further so that there is always a time between successive energizations when neither controllable solid state switching device is conducting current.

7. The push-pull inverter of claim 1 wherein said controllable solid state switching devices comprise transistors.

8. A push-pull ballast for an arc discharge lamp for operation from a power source either higher or lower in voltage than said lamp operating voltage comprising push-pull high frequency inverter means adapted to be connected to a source of unfiltered, pulsating d.c. power, said inverter means including an autotransformer having a plurality of taps including primary and secondary taps for providing a selected voltage change ratio and a pair of controllable solid state switching devices, capable of being turned ON and OFF connected to said primary taps to cause current to flow therein, and rectifier means operatively associated with said secondary taps and a capacitor connected across said source of pulsating d.c. power, having a high impedance at the frequency of said pulsating d.c. power and a low impedance of the frequency of said high frequency inverter, a control circuit, including means generating a variable reference signal, comparator means responsive to said reference signal and said signal proportional to said instantaneous current for providing an output signal when said signal proportional to said instantaneous current exceeds said reference signal by a preselected amount and means responsive to said output signal for controlling current flow alternately through each of said switching devices so that each period of conduction of one of said devices is followed by a period during which neither device is conducting and further for causing each period of conduction to terminate in response to said output signal so that said instantaneous current varies in accordance with said reference signal.

9. The push-pull ballast of claim 8 wherein said means providing a signal proportional to the instantaneous current through said lamp comprises a resistor in series with both of said controllable solid state switching devices so that the total inverter current flows through said resistor whereby a voltage signal is produced across said resistor proportional to said current, and therefore proportional to said instantaneous lamp current.

10. The push-pull ballast of claim 8 wherein said means responsive to said output signal comprises a flip-flop circuit connected to the output of said comparator having two outputs, a Q output and a $\overline{Q}$ output of differing sense, a one-shot multivibrator connected to the output of said comparator having an output and input, first and second AND gates, each having two inputs and one output, one input of each of said AND gates connected to the output of said one shot multivibrator, and the other of said inputs of each first and second AND gates connected to said Q and $\overline{Q}$ outputs of said flip-flop, respectively, and the outputs of said first and second AND gates connected to said controllable solid state switching device, one output to each device so that said controllable solid state switching devices are energized alternately, and further so that there is always a time between successive energizations when neither controllable solid state switching device is conducting.

11. The push-pull inverter of claim 10 wherein said controllable solid state switching devices comprise transistors.

12. The push-pull ballast of claim 6 further including means responsive to the output of said ballast for varying the delay time of said one shot multivibrator.

13. The push-pull ballast of claim 11 further including means responsive to the output of said ballast for varying the delay time of said one shot multivibrator.

14. The push-pull ballast of claim 8 wherein said means providing a signal proportional to the instantaneous current through said lamp comprises a resistor in series with said lamp so that the total lamp current flows through said resistor whereby a voltage signal is produced across said resistor proportional to said current.

15. The push-pull ballast of claim 8 wherein said comparator means further comprises hysteresis means operatively associated therewith so that the output of the comparator will change in sense only when said signal proportional to said instantaneous current differs from said reference signal by an amount which exceeds a preselected value.

16. The push-pull ballast of claim 15 wherein said means responsive to said ouput signal comprises a flip-flop circuit connected to the output of said comparator, and having an input, and outputs Q and $\overline{Q}$ of differing sense, first and second AND gates, each having two inputs and one output, one input of each of said AND gates connected to the input of said flip-flop circuit, and the other input of said first AND gate connected to said Q output of said flip-flop, and the other input of said second AND gate connected to said $\overline{Q}$ output of said flip-flop, said output of said first AND gate connected to one of said controllable solid state switching devices, and said output of said second AND gate connected to the other of said controllable solid state switching devices, so that said controllable solid state switching devices are energized alternately and further so that there is always a time between successive energization when neither controllable solid state switching devices is on.

* * * * *